United States Patent [19]

Mori et al.

[11] Patent Number: 4,529,030

[45] Date of Patent: Jul. 16, 1985

[54] ELECTROMAGNETIC STIRRING METHOD IN HORIZONTAL CONTINUOUS CASTING PROCESS

[75] Inventors: Takasuke Mori, Ashiya; Kenzo Ayata, Kobe; Jun Miyazaki, Kobe; Takahiko Fujimoto, Kobe; Hitoshi Nakata, Toyonaka, all of Japan

[73] Assignee: Kabushiki Kaisha Kobe Seiko Sho, Kobe, Japan

[21] Appl. No.: 572,251

[22] Filed: Jan. 20, 1984

[30] Foreign Application Priority Data

Jan. 20, 1983 [JP] Japan ..... 58-8318

[51] Int. Cl.[3] ..... B22D 27/02

[52] U.S. Cl. ..... 164/468; 164/504

[58] Field of Search ..... 164/504, 468

[56] References Cited

FOREIGN PATENT DOCUMENTS 57-75257 5/1982 Japan ..... 164/468

*Primary Examiner*—Kuang Y. Lin

*Attorney, Agent, or Firm*—Oblon, Fisher, Spivak, McClelland & Maier

[57] ABSTRACT

A horizontal continuous casting process wherein at least two electromagnetic stirring devices of a rotary magnetic field type are arranged in series direction whereby electromagnetic stirring force acts on non-solidified molten metal, and the distance between the electromagnetic stirring devices of first and second stages is set to specified relation.

1 Claim, 8 Drawing Figures

ELECTROMAGNETIC STIRRING METHOD IN HORIZONTAL CONTINUOUS CASTING PROCESS

BACKGROUND OF THE INVENTION

1. Field of the Invention

The present invention relates to electromagnetic stirring method for improving the quality of a continuously cast strand (i.e. c.c. strand) obtained in horizontal continuous casting process, and more particularly to electromagnetic stirring method in which the produced amount of equiaxed crystals in a center portion of the strand is increased and microcavity or center segregation is suppressed such that the integral quality thereof can be improved.

2. Description of the Prior Art

Development and practical application of horizontal continuous casting processes have been rapidly advanced, and application of electromagnetic stirring to the horizontal continuous casting process is now being studied for the same purpose as in secondary cooling zone stirring in vertical continuous casting processes such as an ordinary bending type or curved type, i.e. for the purpose of increasing the equiaxed crystal zone or improving center segregation. The quality improving effect of a c.c. strand by means of electromagnetic stirring is classified as being a surface quality improvement and internal quality improvement. The latter is directed to the fact that the top end of the columnar crystals growing from outside is cut by stirring the flow of molten steel such that a large amount of equiaxed crystal nuclei are thereby produced, and solidified structure at center portion is transformed into equiaxed crystals so as to improve microcavity or segregation in the center portion.

Equiaxed crystal nuclei produced by electromagnetic stirring are settled by means of the effect of gravity. In the case of an ordinary continuous casting device of a vertical type or a curved type, the c.c. strand is drawn downwards and therefore equiaxed crystal nuclei are apt to settle in the drawing direction and nearly at the center of a cross-section of the c.c. strand. In the horizontal continuous casting process, however, the c.c. strand is drawn in the horizontal direction and therefore equiaxed crystal nuclei settle so as to be accumulated in a downward direction.

For example, referring to FIG. 1 showing a schematic transverse sectional view of a c.c. strand obtained by stirring of one stage in an ordinary horizontal continuous casting process, equiaxed crystals are accumulated at the lower side during drawing of the strand and the upper side is apt to be occupied by columnar crystals and thus resulting in serious problem occurring from the viewpoint of quality (In FIG. 1, A is a columnar crystal forming zone, B denotes an equiaxed crystal forming zone, and broken line W indicates the depth of solidified shell thickness). In this connection, it is known that development of columnar crystals causes an increase of center segregation. For example, if such c.c. strand is rolled into welding steel material, welding defects will occur at the segregation portion. If the strand is formed into a wire rod, a cuppy fraction is produced and drawing of thin wire cannot be performed. Furthermore, if the strand is used for cold-rolled thin sheet, a fine ridging flaw may occur on the skin of steel sheet surface, most notably in stainless steel. Since the solidified structure is not uniform in the vertical direction of the transverse cross-section, the above-mentioned defect will be deviated to one side of the product.

In order to eliminate above-mentioned disadvantages, a method as set forth in Japanese patent application laid-open No. 57-75258 was proposed. In this method, equiaxed crystal nuclei are transferred towards the crater end using an electromagnetic stirring coil of a linear motor type so as to enlarge the equiaxed crystal forming zone and obtain a uniform solidified structure similar to c.c. strand in vertical continuous casting process. However, this method requires a long coil due to the special condition in the structure of a linear motor type coil, and since uniform spray cooling throughout such a long coil is difficult, a lack of uniformity in the cooling tends to cause surface cracking or deformation in the c.c. strand. Moreover, a coil of linear motor type has a poor stirring efficiency in comparison with that of a rotary magnetic field type, and, in order to attain the stirring efficiency comparable with that of the coil of rotary magnetic field type, a coil of large size must be used. Therefore the cost for equipment increases.

SUMMARY OF THE INVENTION

In view of above-mentioned circumstances, an object of the present invention is to use an electromagnetic stirring device of rotary magnetic field type in a horizontal continuous casting process.

Another object of the invention is to increase the equiaxed crystal producing ratio using the electromagnetic stirring device of rotary magnetic field type.

Still another object of the invention is to provide a uniform solidified structure without causing a problem of lack of uniformity in the cooling process.

In order to attain above objects, an electromagnetic stirring method in a horizontal continuous casting process according to the invention consists in arranging at least two electromagnetic stirring devices of rotary magnetic field type in series such that an electromagnetic stirring force acts on non-solidified molten metal and a distance L in cm between the electromagnetic stirring devices of first and second stages is set to comply with equation (I) as follows:

$$L \leqq V(10 \times W + 4) \quad \text{(I)}$$

wherein

V: c.c. strand drawing speed (cm/sec)

W: liquid core diameter (cm) at the rear end of the electromagnetic stirring device of first stage

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Various embodiments of the invention will now be described in detail referring to the accompanying drawings.

Figure 1:
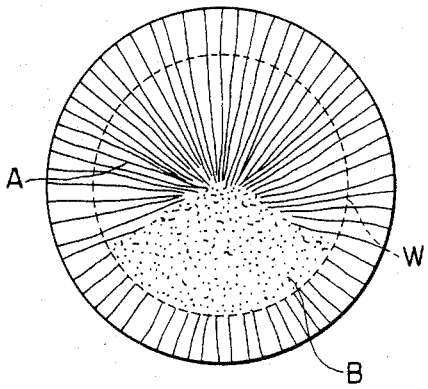
FIGURE 1 PRIOR ART
FIG. 1 is a schematic sectional view illustrating a c.c. strand in a horizontal continuous casting process obtained using an electromagnetic stirring method of one stage in the prior art.
Figure 4:
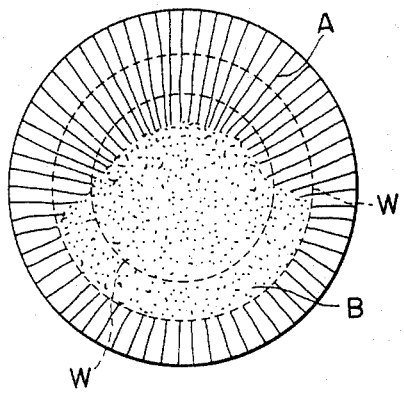
FIG. 4 is a schematic sectional view illustrating an example of a c.c. strand obtained according to the invention.
Figure 2:
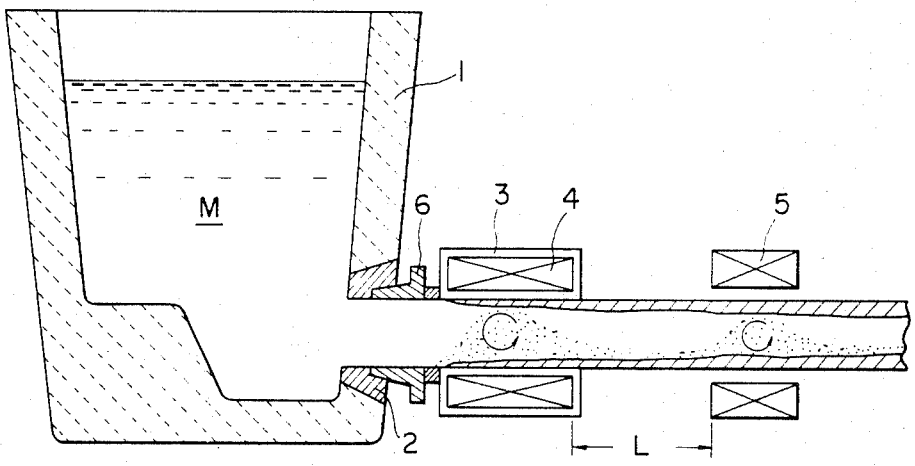
FIG. 2 is a schematic longitudinal sectional view illustrating one embodiment of the invention.
Figure 3:
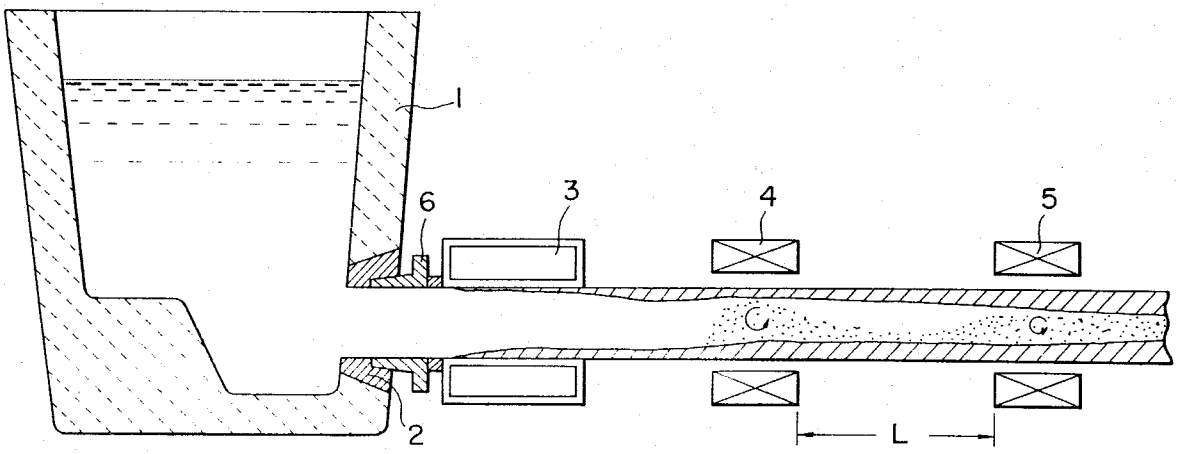
FIG. 3 is a schematic longitudinal sectional view illustrating a modification of the invention.

Referring to FIG. 2 showing a schematic longitudinal sectional view of an embodiment, molten steel M charged in a tundish 1 is sequentially fed through a tundish nozzle 2, a feed nozzle 6 and a water-cooling nozzle 3, and solidified from outside. The molten steel is intermittently drawn to the right in the figure. In this embodiment, an electromagnetic stirring device 4 of a first stage (i.e. of a rotary magnetic field type unless otherwise specified hereinbelow) is disposed within the watercooling mold 3 so as to surround the c.c. strand, and an electromagnetic stirring device 5 of second stage is disposed downstream and spaced by suitable distance L (cm) from the first stirring device 4. A modification as shown in FIG. 3 may be used where an electromagnetic stirring device 4 of the first stage is disposed downstream of an water-cooling mold 3, and an electromagnetic stirring device 5 of the second stage is disposed downstream of the first stirring device 4 and spaced by a suitable distance L (cm) therefrom. In the first stirring device 4, the top end of columnar crystals growing from the outside is cut by stirring flow of molten steel at non-solidified state and a large amount of equiaxed crystal nuclei are grown. Equiaxed crystal nuclei grown in such manner are settled by means of gravity after removing the influence of electromagnetic device 4 as hearinbefore described. If the c.c. strand in this state is drawn, columnar crystals at lower side are obstructed by the settled equiaxed crystals and are not further grown, whereas columnar crystals at upper side towards a center portion because there is no crystal nucleus to obstruct the growth at the top end of columnar crystals. As a result, equiaxed crystals B are distributed only at the lower side of cross-section of the c.c. strand and the upper side is almost occupied by columnar crystals A as shown in FIG. 1. In the present invention, downstream of the electromagnetic stirring device 4 of first stage is installed the electromagnetic stirring device 5 of the second stage, whereby the top end of columnar crystal being grown at upper side is cut and the required crystal nuclei already settled are again dispersed. At this time point, water cooling from outside also considerably decreases also the temperature of the molten steel at center portion and elevates viscosity of the whole molten steel including equiaxed crystal nuclei. Thus the settling of equiaxed crystal nuclei after passing through the electromagnetic stirring device 5 becomes quite slow. The growth of columnar crystals at the upper side is obstructed by equiaxed crystal nuclei which are again dispersed in molten steel and cover the top end of columnar crystals, and the cross-section of c.c. strand afterwards becomes completely solidified as shown in FIG. 4 where the forming zone of equiaxed crystals B is enlarged to the upper side and the forming zone of columnar crystals A is significantly decreased.

The inventors has conducted detailed further studies regarding the equiaxed crystal zone enlarging effect due to the electromagnetic stirring of two stages. As a result of the study, it has been known that above-mentioned effect is reliably developed if the time from the first electromagnetic stirring device to the second stirring device is set to comply with equation (II) as follows:

$$T \leqq 10 \times W + 4 \qquad \text{(II)}$$

wherein

Figure 5:
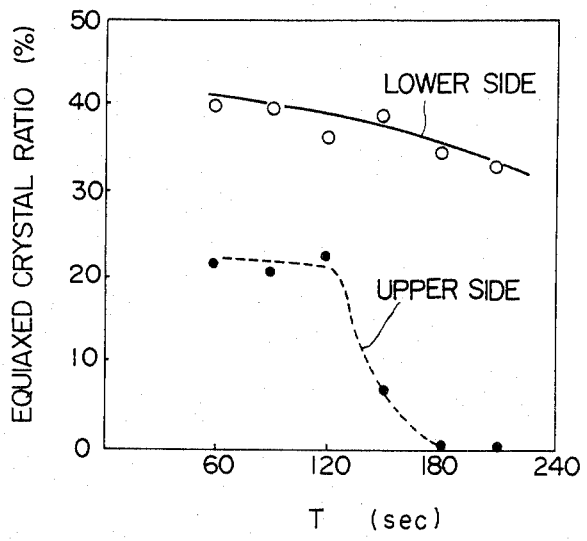
FIGS. 5 and 6 are graphs illustrating the relation of the equiaxed crystal ratio versus time T.

T: time (sec) required for the c.c. strand to be transferred from the first stirring device to the second stirring device W: liquid core diameter (cm) at the rear end of the first electromagnetic stirring device Referring to FIG. 5, when the c.c. strand of 150 mm is drawn at a speed of 1.0 m/min using molten steel of 0.6% C, the electromagnetic stirring device of the first stage is installed within the water-cooling mold and the position of the electromagnetic stirring device of the second stage to be installed at rear side of outlet of the mold is varied such that the above-mentioned time T is varied and the measuring result of the equiaxed ratio of the c.c. strand (ratio of width of the equiaxed crystal producing zone in a vertical cross-section of the c.c. strand) is plotted in a graph. In this case, the liquid core diameter at the rear end of the electromagnetic stirring device of first stage is 11.6 cm.

As clearly seen from the graph, the equiaxed crystal ratio decreases rapidly if the time T becomes more than 120 (i.e. $10 \times 11.6 + 4$) sec. Therefore the time T must be less than 120 sec in order to elevate the equiaxed crystal ratio.

Figure 6:
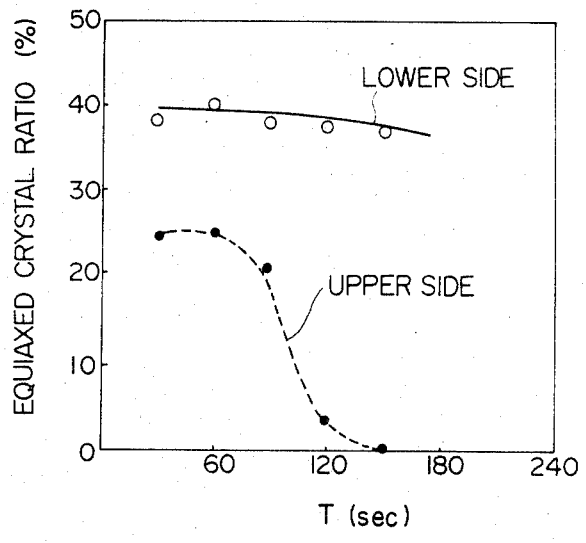

FIG. 6 also shows a variation of the equiaxed ratio, when c.c. strand of 110 mm is drawn at speed of 2.0 m/min using molten steel of 0.6% C, the electromagnetic stirring device of the first stage is installed within the water-cooling mold and the position of the electromagnetic stirring device of the second stage to be installed at the rear side of the outlet of the mold is varied whereby the above-mentioned time T is varied. In this case, the liquid core diameter at the rear end of the electromagnetic stirring device of first stage is 8.6 cm.

In this experiment result, the equiaxed crystal ratio decreases rapidly if the time T becomes more than 90 (i.e. $10 \times 8.6 + 4$) sec.

It is clearly understood from these experimental result that the equiaxial crystal ratio can be securely elevated if the time T relating to the liquid core diameter W is set to comply with equation (II). Since the time T is equal to value of the distance L (cm) between the first electromagnetic stirring devices divided by the drawing speed V, the following equation (III) can be derived from above-mentioned equation (II). Further, equation (III) may be transformed into above-mentioned equation (I).

$$T = L/V \leqq (10 \times W + 4) \qquad \text{(III)}$$

That is, if the distance L between both stirring devices is suitably adjusted corresponding to the liquid core diameter, a high equiaxed crystal ratio is stably obtained.

Figure 7:
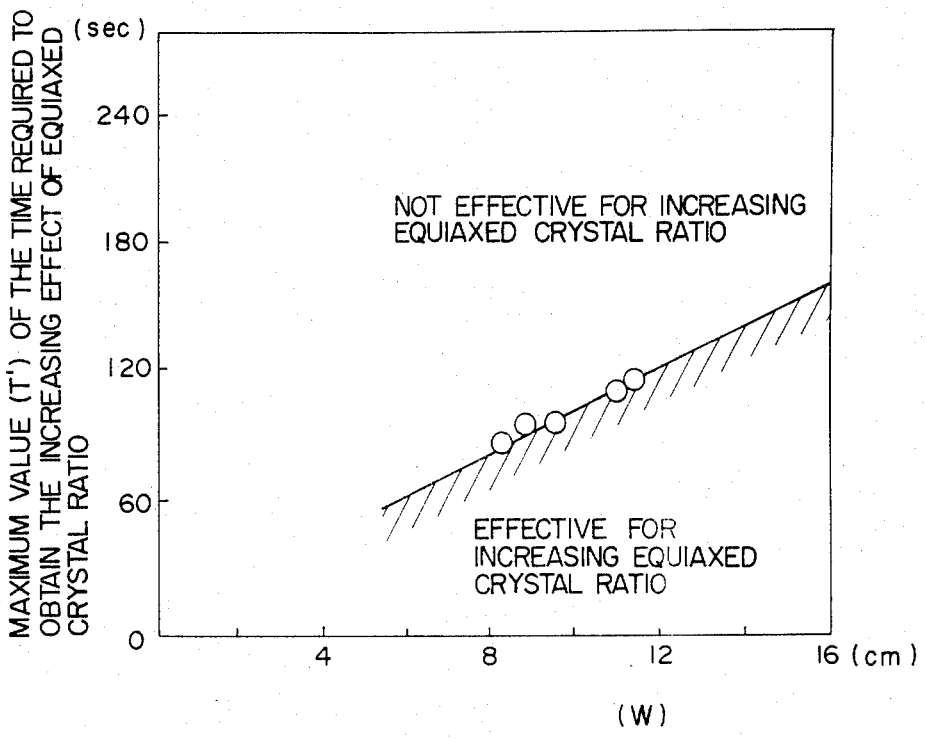
FIG. 7 is a graph illustrating the relation between a maximum value T' of time duration T to provide an equiaxed crystal increasing effect and a liquid core diameter W.

FIG. 7 shows a graph of an experimental result illustrating the relation between the maximum value T' of time T and liquid core diameter W affecting the increasing tendency of the equiaxed crystal ratio, when horizontal continuous casting of a c.c. strand of 150 mm and 110 mm is performed using high-speed steel 62A (0.61% C-0.2% Si-0.50% Mn-0.022% P-0.031% S-0.013% Al). It is clear from this figure that maximum value T' of the time T required to obtain the increasing effect of equiaxed crystal ratio is proportional to the liquid core diameter W.

Figure 8:
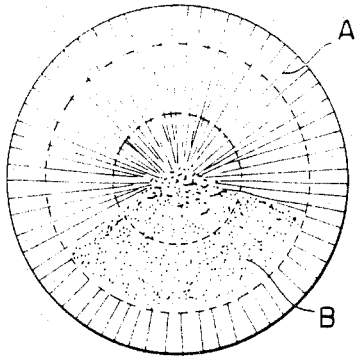
FIG. 8 is a schematic sectional view of a c.c. strand in the situation where the distance between stirring devices of first and second stages is too long.

The reason why the distance L beyond $(10\times W+4)$ cannot obtain the increasing effect of the equiaxed crystal ratio seems to be as follows: If the distance L is too long, the time interval between the first stirring and second stirring is too long and therefore equiaxed crystal nuclei produced based on the first stirring are settled and growth of columnar crystals from the upper side of molten metal progresses excessively, thus cutting of columnar crystals by restirring becomes more difficult and the dispersion region of the equiaxed crystals becomes too narrow to obtain the increasing effect. In this connection, FIG. 8 is a schematic view of the cross-section of the c.c. strand obtained when the distance L is too long. In the figure, growth of columnar crystals A from the upper side progresses excessively and therefore equiaxed crystals B are produced only at the lower side similar to the prior art shown in FIG. 1.

Although a typical example of manufacturing a c.c. strand with a circular cross-section in the accompanying drawings has been described, the shape of the cross-section of the c.c. strand is not restricted to this shape but invention instead be of square cross-section or rectangular cross-section where casted continuously. The liquid core diameter W in this case may be based on a minimum cross-section length of the non-solidified molten metal within the c.c. strand.

In the present invention as above described, equiaxed crystals are produced by the electromagnetic stirring device of first stage and settled downstream of the stirring device of first stage and then dispersed again by the electromagnetic stirring device of second stage whereby the equiaxed crystal ratio is increased. It seems that a similar effect can be obtained also by installing the electromagnetic stirring device of only one stage and strengthening the stirring force and increasing the length of stirring device. In fact, as a result of the confirmation experiment, the increasing effect of the equiaxed crystal ratio being nearly equal to that in the invention was obtained. However, since the stirring is performed by strengthening the stirring force in this method, the negative segregation zone (also called white band) then formed is apt to increase whereby uniformity of the c.c. strand is obstructed. Accordingly, it is essential in the present invention that at least two electromagnetic stirring devices be installed in series. Although example using two electromagnetic stirring devices are shown in the figure, it is preferable that three or more electromagnetic stirring devices be used to elevate the equiaxed crystal ratio when the cross-section of c.c. strand is large. In this case, of the course, the distance L between respective electromagnetic stirring devices must be set to comply with above-mentioned equation (I).

The present invention is constituted as above described and therefore has the effects that the equiaxed crystal ratio at center portion of c.c. strand can be elevated to degree similar to the c.c. strand in vertical continuous casting process, any deviation of equiaxed crystals to lower side is eliminated and uniformity of the solidified structure is secured, whereby the quality of the c.c. strand in the horizontal continuous casting process is improved significantly.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United is:

1. An electromagnetic stirring method in a horizontal continuous casting process, which comprises:

arranging at least a first and second electromagnetic stirring device of a rotary magnetic field type in series such that an electromagnetic stirring force acts in a first and second stage on nonsolidified molten metal; and spacing the electromagnetic stirring devices of said first and second stages so as to comply with the following equation:

$$L \leqq V(10\times W+4)$$

wherein V denotes the continuous cast strand drawing speed in cm/sec; W indicates the liquid core diameter in cm at a rear end portion of the electromagnetic stirring device of said first stage; and L denotes the distance in cm between said first and second stage.

* * * * *